United States Patent [19]

Stevens

[11] 4,286,412

[45] Sep. 1, 1981

[54] HOLD-OPEN DEVICE FOR USE WITH CONVENTIONAL DOOR CLOSER

[75] Inventor: William E. Stevens, Monroe, N.C.

[73] Assignee: Scovill Inc., Waterbury, Conn.

[21] Appl. No.: 60,825

[22] Filed: Jul. 25, 1979

[51] Int. Cl.[3] ..... E05F 1/00; E05C 17/04

[52] U.S. Cl. ..... 49/379; 292/270; 292/274

[58] Field of Search ..... 49/379; 292/270, 271, 292/272, 273, 274, 275; 16/49

[56] References Cited

U.S. PATENT DOCUMENTS

| | | | |
|---|---|---|---|
| 2,277,316 | 3/1942 | Garrison | 16/49 X |
| 3,164,404 | 1/1965 | Arnold | 292/273 |
| 3,630,560 | 12/1971 | Atkins et al. | 292/270 |
| 3,771,823 | 11/1973 | Schnarr | 292/270 |
| 3,926,461 | 12/1975 | D'Hooge | 292/275 |

*Primary Examiner*—Kenneth Downey

*Attorney, Agent, or Firm*—Dallett Hoopes

[57] ABSTRACT

Door holder is adapted to work with conventional door closer. Holder comprises a shoe moving along a track and connected to the closer operating arm. A latch, when device is activated, holds shoe with door in open condition. Latch is attached to a frame near the track and which may be moved away from latching engagement with shoe either by forcible closing of the door manually or by de-activating closer.

7 Claims, 8 Drawing Figures

HOLD-OPEN DEVICE FOR USE WITH CONVENTIONAL DOOR CLOSER

BACKGROUND OF THE INVENTION

1. Field of the Invention

This invention relates to a selectively operable hold-open device for use with a conventional door closer. More specifically, the invention relates to a hold-open device for a swinging door, the device adapted to be made effective by power means such as a solenoid and rendered ineffective permitting the door to close either by de-activation of the same power means or by being overcome by forcible manual closing of the door.

2. Description of the Prior Art

In the prior art there are a number of devices adapted to be used with the single operating arm of a conventional door closer mounted on a swinging door for the purpose of holding the door open. Typically, such devices are used in hospitals, for instance, whereby the door may be manually held open by the device until its power means are actuated to release the door to permit it to close. Such an arrangement has been used in situations wherein in the event of fire, for instance, the door to a patient's room is automatically closed. Examples of the prior art include the U.S. Pat. No. 3,771,823, issued to Schnarr, wherein a hooked shoe rides in a track on the door frame and is connected to a door closer mounted on a door. The hooked shoe in the hold-open position is engaged by a pair of mating hooks which are solenoid-actuated and releaseably hold the shoe with the door in the hold-open position. Other examples of such hold-open devices are found in U.S. Pat. No. 3,164,404, issued Jan. 5, 1965 to Arnold, U.S. Pat. No. 3,926,461, issued Dec. 16, 1975 to D'Hooge.

SUMMARY OF THE INVENTION

Under the present invention, as in some past units, a shoe attached to the operating arm of the door closer travels along a track mounted on a door frame. The shoe, in its travel adjacent the open position, passes a latch mounted on a movable frame adjacent the track and, with the frame bearing the latch in operable position, it automatically catches the shoe and does not release it. This holds the door open. A release can be accomplished by moving the frame so that the latch assumes a second position permitting passage of the shoe. The movement of the frame is either accomplished by a reversal of the same power means or by a forcible closing pressure on the door to result in a forced retraction of the movable frame.

BRIEF DESCRIPTION OF THE DRAWINGS

Further objects and features of the invention will be apparent from a reading of the attached specification and drawings, all of which disclose a non-limiting form of the invention. In the drawings.

DESCRIPTION OF THE PREFERRED EMBODIMENT

Figure 1:
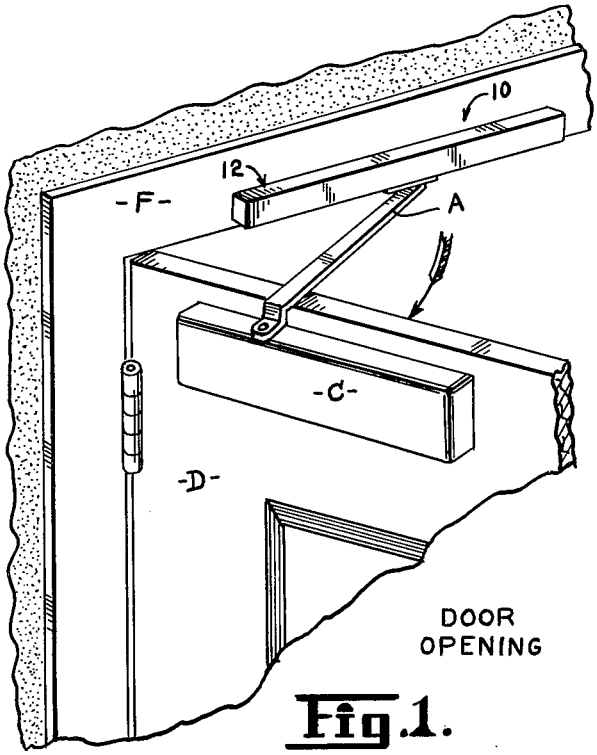
FIG. 1 is a fragmentary perspective view showing a door associated with a holder of the invention being opened.
Figure 2:
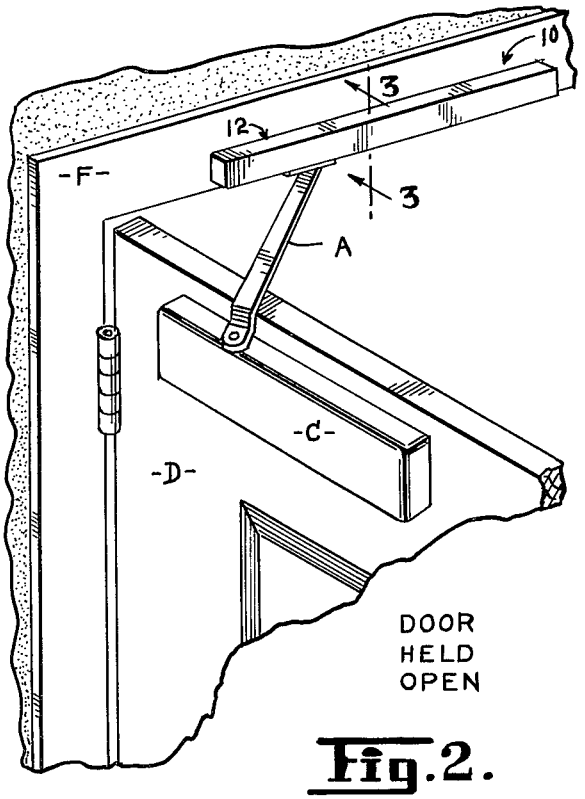
FIG. 2 is a fragmentary perspective view showing the door held in the open condition.

A door hold-open device embodying the invention is generally designated 10 in FIG. 1. It is mounted on the frame F of a door D and is attached to the arm A of a conventional closer C.

While the arrangement can be otherwise, that is, with the closer mounted on the frame and the track mounted on the door, the invention is well disclosed in the shown drawings wherein the hold-open device is frame-mounted.

The hold-open device comprises a combined track and housing 12. Preferably, this is in the form of a channel-shaped extrusion (FIG. 4) having a top wall 14, depending sidewalls 16, and intermediate reinforcing web 17, and inward track flanges 18.

Figure 8:
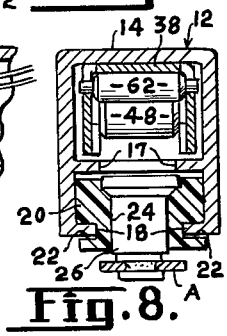
FIG. 8 is a sectional view taken on the line 8—8 of FIG. 7.

Slideably mounted along the track flanges 18 is a shoe 20 (FIGS. 3, 8) which is a generally rectangular solid having slots 22 along the opposite sides thereof adapted to receive the track flanges 18 (FIG. 8). The shoe is formed with a vertical bore 24 (FIG. 3) which is countersunk at its upper end and receives a cylindrical rivet 26 having an enlarged head at its upper end received into the counterbore. At the lower end, the rivet 26 is formed with a reduced neck adapted to receive the opening at the end of the door closer arm A and to be headed as at 28 to pivotally connect the rivet and the arm. Adjacent the opposite end of the shoe a recess 30 is formed and a pronounced rib 32 extends upward thereadjacent, the recess and the rib forming between them a latch-receiving corner or recess 34.

Secured to the combined housing and track and adapted to serve as a stop for the travel of the shoe is the stop block 36.

Figure 4:
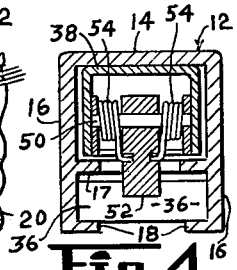
FIG. 4 is a sectional view taken on the line 4—4 of FIG. 3.

Within the housing/track assembly is disposed a channel-shaped sub-housing 38 with a downwardly-facing opening 40 and which is preferably secured to the upper wall 14 of the outer housing-track unit. The sub-housing is formed with a transverse pin 42. A frame 44, with a pair of parallel sidewalls, is formed with apertures in alignment to pivotally receive the pin 42 to attach the frame inside the sub-housing. The end of the frame carries a journal pin 46 which journals a roller 48. Latch pin 50 also is mounted between the two side plates of the frame 44. Pivotally mounted on the pin 50 is an upside down teardrop-shaped latch 52. In the area of the latch, the web 17 is apertured as at 52 to permit clearance of the latch as it pivots. As best shown in FIG. 4, spiral springs 54 surround the pin 50 on opposite sides of the latch, the ends of the springs being disposed respectively in small openings 56 and 58 in the adjacent sidewall of the frame 44 and the latch 52 respectively to bias the latch in a position generally perpendicular to the frame 44 but yielding to permit pivoting in either direction.

Figure 5:
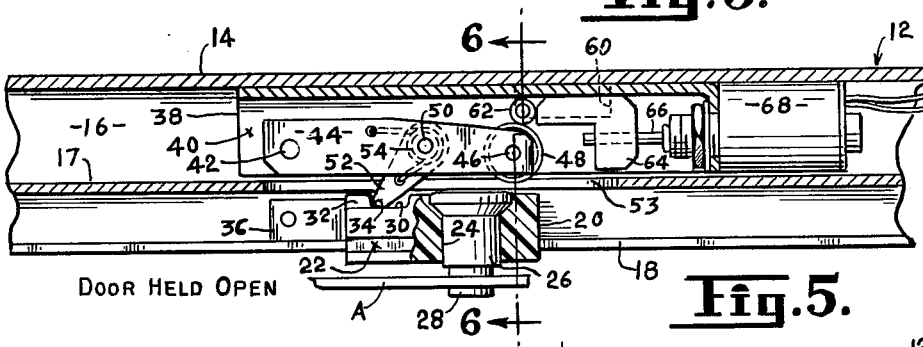
FIG. 5 is a sectional view like FIG. 3, but showing the latch and shoe in hold-open condition.
Figure 6:
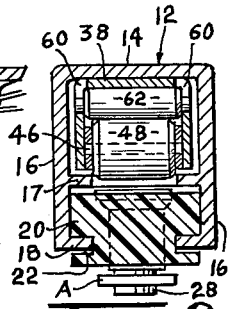
FIG. 6 is a sectional view taken on the line 6—6 of FIG. 5.

The sub-housing 38 is slotted in alignment on both sidewalls as at 60 (FIGS. 5 and 6) to journal the pintles or stub shafts of a small roller 62. The slots 60 permit a change in position of the roller 62 from a first position as shown in FIG. 5 where it is slightly offset to the right from the vertical of the axis of roller 48 to a second position alongside the roller 48. The roller 62 is engaged by the leading narrow end of an L-shaped drive head 64 mounted on the armature rod 66 of an electric solenoid 68. In practice, the solenoid may be alternatively an air barrel-and-piston assembly with the piston rod taking the place of the armature rod 66. The air barrel or solenoid body, or other power means, is rigidly mounted in the housing/track means.

OPERATION

Figure 3:
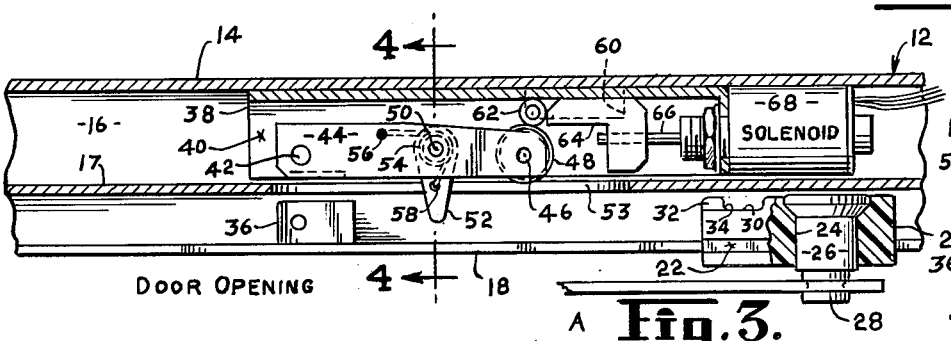
FIG. 3 is a sectional view taken on the line 3—3 of FIG. 2.

In operation, with the arm A connected to the rivet 26 in turn rotatably mounted in the shoe 20, the manual openings and closings of the door cause the shoe 20 to move along the track flanges 18. As shown in FIGS. 1 and 3, with the door approaching the full open position, the shoe 20 approaches the latch 52 and the stop 36.

Assuming the armature rod 66 is extended as by the actuation of the solenoid 68 or other power means, the roller 62 is in its first position shown in FIG. 3. Because this necessarily involves the extension of the armature rod 66 and the head 64 and because the roller 62 comprises part of the power means, the power means in the situation shown in FIG. 3 is said to be in the first position. In the first position, the roller 62 wedges between the top wall of the sub-housing 38 and the roller 48 with the consequence that the frame 44 and the latch 52 are held in the closest position to the path of the shoe 20, or the latch position.

When the shoe moves as the door is opened further to a position adjacent the stop 36, it will be seen that the projection has brushed by the spring-biased latch 52 so that the nose of the latch 52 is now trapped in the latch-receiving corner recess 34 of the shoe. From this position, as shown in FIG. 5, it is not possible for the shoe 20 to move rightwardly as is required for the door to close. Thus, as long as the parts are in the position shown in FIG. 5, the door is held open against the closing bias of the operator C.

The unlatching of the hold-open device may be accomplished in either of two ways. First, by the movement of the frame 44 away from the shoe 20 upon the removal of the power means from the first position to the second position as by deactivation of solenoid 68, or, second, by the forced removal of the power means as by the forcible closing pressure on the door.

Figure 7:
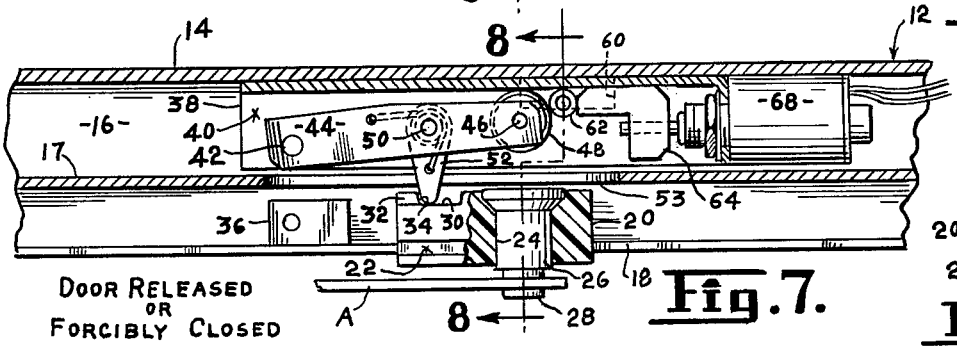
FIG. 7 is a sectional view similar to FIG. 5 but showing the release of the door holder and the movement of the shoe from the open position toward the closed position.

More specifically, if, as in the event of fire or smoke or other reason, the electric power to the solenoid 68 is cut, spring means in the solenoid or rightward pressure by the roller 48 on the roller 62 moves the roller 62 to its second position (FIG. 7) to permit the roller 48 to raise as the frame 44 pivots upwardly as shown. It should be understood that the rightward pressure on the roller 62 (FIG. 5) is the result of the geometry inherent in the position of pin 42 and the arcuate path of the roller 48 as the frame 44 swings about pin 42. The arcuate swing results in a rightward component on roller 62. Because of this component of force, it is not necessary to have the armature rod 66 spring-biased rightwardly. It is clear that the upward pivoting movement of the frame 44 about the pin 42 is effected by the upward component of the latch 52 due to the rightward pressure of the closer arm A on the shoe 20.

The power means can also be moved from first position to second position by a substantial increase in the rightward pressure on the shoe 20 (FIG. 5) brought about by the forcible manual pressure on the door in the closing direction. This increases the upward force on the latch 52 to result in increased upward force on roller 48 and increased rightward force on roller 62 to overcome the power of the solenoid 68 even though the solenoid may be on at the time.

It will be clear from the foregoing description that the arrangement disclosed is effective and durable and not susceptible to wear or breakage through misuse. It should be clear that variations are possible and that, for instance, the track unit and the closer can be interchanged to leave the track unit on the door and the closer mounted on the door frame.

Thus, the invention is susceptible of variations from the embodiment shown. The invention is therefore definable by the following claim language including equivalents thereof.

I claim:

1. A selectively operable hold-open device for use with a conventional single-arm door closer, mounted on a swinging door comprising:
   (a) track means;
   (b) shoe means adapted to be connected to the distal end of the door closer arm and to move along the track means, the shoe means having a latch-receiving recess;
   (c) a movable frame pivotally mounted adjacent the track means;
   (d) a latch pivotally secured to the frame and pivoting about a fixed pivot point on the frame;
   (e) power means disposed adjacent the track and adapted to selectively assume a first position to hold the frame with the latch in the path of the shoe in latch position so that when the recess on the shoe passes the latch as the door approaches open condition, the shoe can not pass back the other way without the latch engaging the recess and holding the shoe unless the power means moves or is moved out of the first position.

2. A hold-open device as claimed in claim 1 wherein the distal end of the frame carries a first roller and the latch means extends toward the track from intermediate the ends of the frame and a second roller comprising part of the power means is adapted to engage the first roller to hold the frame in said latch position.

3. A hold-open device as claimed in claim 2 wherein the latch means is teardrop-shape and is pivoted at its thicker end to the frame, and is spring-biased to a position at which it is disposed perpendicular to the path of the shoe.

4. A hold-open device as claimed in claim 2 wherein the frame is mounted in a U-shaped housing and the second roller is disposed between the intermediate wall of the housing and the first roller.

5. A hold-open device as claimed in claim 4 wherein the second roller is formed with a pair of outward pintles and is supported by its pintles in a pair of aligned slots in the sidewalls of the housing.

6. An assembly including a swinging door member mounted in a door-frame member, a conventional door closer having an operator and arm mounted on one of said members, a track mounted on the other of said members, a shoe riding in the track and carried on the distal end of the arm, pivoted latch means on said other member adapted to engage the shoe and hold it with the door in open position, the latch being pivotally mounted on a frame in turn pivotally mounted at one end of the track, and power means adapted to pivot the frame to a latch position adjacent the track, whereby when the frame is in the latch position adjacent the track, the latch catches the shoe and thereby holds the door open and thereafter the door may be closed by either manually forcing the door to overcome the power means or by de-activating the power means.

7. An assembly as claimed in claim 6 wherein the latch means is spring-biased toward a position perpendicular to the track.

* * * * *